US008182211B2

(12) United States Patent
Steiger et al.

(10) Patent No.: US 8,182,211 B2
(45) Date of Patent: May 22, 2012

(54) TURBO MACHINE

(75) Inventors: Ulrich Steiger, Baden-Daettwil (CH); Sven Olmes, Villigen (CH)

(73) Assignee: ALSTOM Technology Ltd., Baden (CH)

( * ) Notice: Subject to any disclaimer, the term of this patent is extended or adjusted under 35 U.S.C. 154(b) by 1308 days.

(21) Appl. No.: 11/841,333

(22) Filed: Aug. 20, 2007

(65) Prior Publication Data

US 2008/0050233 A1 Feb. 28, 2008

(30) Foreign Application Priority Data

Aug. 25, 2006 (CH) ..... 1359/06

(51) Int. Cl.
*F01D 11/02* (2006.01)

(52) U.S. Cl. ..... 415/173.7; 415/174.5

(58) Field of Classification Search ..... 415/173.1, 415/173.4, 173.5, 173.7, 174.4, 174.5
See application file for complete search history.

(56) References Cited

U.S. PATENT DOCUMENTS

| | | | | |
|---|---|---|---|---|
| 1,708,044 | A * | 4/1929 | Baumann | 277/418 |
| 3,251,601 | A * | 5/1966 | Harvey | 277/424 |
| 4,103,899 | A * | 8/1978 | Turner | 277/304 |
| 5,029,876 | A | 7/1991 | Orlando et al. | |
| 5,791,873 | A | 8/1998 | Kreitmeier | |
| 5,961,279 | A * | 10/1999 | Ingistov | 415/170.1 |
| 5,967,746 | A * | 10/1999 | Hagi et al. | 415/174.4 |
| 2004/0239040 | A1 | 12/2004 | Burdgick | |

FOREIGN PATENT DOCUMENTS

| | | |
|---|---|---|
| DE | 668667 | 12/1938 |
| DE | 3940607 | 6/1990 |
| DE | 102004026503 | 12/2004 |
| EP | 0799973 | 10/1997 |
| EP | 1079070 | 2/2001 |

OTHER PUBLICATIONS

Search Report from European Patent App. No. 07114082.6 (Dec. 21, 2007).
International Search Report for Swiss Patent App. No. 01359/06 (Dec. 16, 2006).

* cited by examiner

*Primary Examiner* — Nathaniel Wiehe
(74) *Attorney, Agent, or Firm* — Cermak Nakajima LLP; Adam J. Cermak

(57) ABSTRACT

A turbomachine (1), in particular a gas turbine, has a stator (2) and a rotor (3) and with at least one axial sealing device (6) arranged between them. On the stator side, the sealing device (6) has a radially stepped sealing contour (8) with regions (9, 10) projecting and retracting in the direction of the rotor (3), on the rotor side a plurality of sealing fins (11) projecting in the direction of the stator (2) being arranged, which engage in each case into adjacent retracting regions (10) of the stator-side sealing contour (8). On the rotor side, at least one additional fin (12) projecting in the direction of the stator (2) is provided, which is positioned between two adjacent sealing fins (11) arranged on the rotor side and which lies opposite a projecting region of the stator-side sealing contour (8).

7 Claims, 2 Drawing Sheets

TURBO MACHINE

This application claims priority under 35 U.S.C. §119 to Swiss application number No. 01359/06, filed 25 Aug. 2006, the entirety of which is incorporated by reference herein.

BACKGROUND OF THE INVENTION

1. Field of the Invention

The invention relates to a turbomachine, in particular a gas turbine, with a rotor and a stator and with an axial sealing device arranged between the rotor and the stator.

2. Brief Description of the Related Art

So that as high efficiency as possible can be generated in modern turbomachines, particularly in gas turbines or compressors, it is desirable to seal off the turbomachine effectively and thereby avoid both a loss of hot gases driving the turbomachine and an eruption of cooling gases which lower the temperature within the turbomachine and consequently adversely influence efficiency. A particular problem in sealing off turbomachines of this type arises especially when the sealing device is arranged between structural components which move in relation to one another. This is the case, for example, in a sealing device which is arranged between a rotating rotor and a stator which is stationary in relation to the latter. Additional relative movements of the sealing device components lying opposite one another occur at the transition from the thermally cold state of rest into the hot operating state on account of thermal expansion and of mechanical load in the case of different material properties of the load-bearing parts.

Normally, in sealing devices of this type, a sealing contour stepped radially on the stator side is provided, which has regions projecting and retracting in the direction of the rotor. In this case, on the rotor side, a plurality of sealing fins projecting in the direction of the stator are arranged, which engage in each case into adjacent retracting regions of the stator-side sealing contour. The sealing fins and the associated sealing contours can thus provide what is known as a labyrinth seal, the sealing action of which may additionally be increased, in that the sealing contour is produced from a strippable material and the sealing fins are produced from a stripping material; when the turbomachine is in operation, the sealing fins come to bear against the sealing contours or even dig into them. Such digging, however, causes a wear of the sealing device which is not to be underestimated, with the result that the latter slowly loses its sealing action again over a period of time.

In addition to reducing the efficiency of the turbomachine, a poor sealing property of the sealing device also results in an eruption of hot gas in the sealing region, which speeds up an oxidation process and therefore also corrosion.

SUMMARY

This is where the invention comes in. Aspects of the invention are concerned with the problem of specifying, for a turbomachine of the generic type, an improved or at least another embodiment which is distinguished particularly by an improved sealing action of an associated sealing device.

One of numerous aspects of the present invention is based on the general idea, in a turbomachine with at least one axial sealing device arranged between a rotor and a stator, of providing, in addition to the sealing fins already normally present, what are known as additional fins which increase the labyrinth effect of the sealing device and thereby improve the sealing action of the sealing device. In this case, the sealing device has on the stator side a radially stepped sealing contour with regions projecting and retracting in the direction of the rotor. Sealing fins arranged on the rotor side and projecting in the direction of the stator engage in each case into adjacent retracting regions of the stator-side sealing contour, thus already affording a certain labyrinth seal in conventional sealing devices. According to the invention, then, on the rotor side, at least one additional fin projecting in the direction of the stator is provided, which lies opposite a projecting region of the stator-side sealing contour and is positioned between two adjacent fins arranged on the rotor side. Thus, the overall number of fins is increased and the labyrinth effect of the sealing device is thereby improved. The additional fins may in this case be designed in the same way as the sealing fins and consist, for example, of stripping material, whereas the opposite sealing contour consists of material to be stripped off, so that, if appropriate, the additional fins, too, can dig into a surface of the sealing contour. Normally, both the additional fins and the sealing fins bear against the opposite regions of the sealing contour. Both the additional fins and the sealing fins are in this case designed as contours continuous in the circumferential direction of the rotor, with the result that these acquire the shape of a collar projecting from the rotor. The stator-side sealing contour is likewise constructed essentially uniformly in the circumferential direction, so that the regions of the sealing contour which project and retract radially in axial longitudinal section are of annular form. In any event, the arrangement of at least one additional fin improves the labyrinth effect and consequently the sealing action of the sealing device considerably.

Expediently, at least one additional fin and/or one sealing fin are/is arranged, inclined radially and axially, on the rotor or on a rotor-side heat shield. An inclination of the sealing fin or of the additional fin in the direction opposite to the main flow in this case increases a dam flow, located upstream and downstream of the respective fin in the flow direction, or what is known as a 'dead water zone', which counteracts the flow and thereby improves the sealing action of the sealing device. At the same time, it is conceivable that, at high rotational speeds, the inclined fins are deformed radially outward on account of the centrifugal forces and thereby come to bear against the opposite sealing contour. Here, too, once again, a digging of the fins in the honeycomb-shaped sealing structure may occur, in which case a stripping of material is to take place solely in the region of the sealing contour.

In a further advantageous embodiment according to the present invention, the sealing fins and/or the additional fin have in each case a wedge-shaped cross-sectional profile in the circumferential direction. A wedge-shaped cross-sectional profile of this type provides a broad tie-up base to the rotor and consequently a reliable connection of the fin to the rotor and, at the same time, a weight-optimized fin, since the latter tapers radially outward. This is beneficial particularly for the action of centrifugal forces, since a fin of constant cross section would generate markedly higher centrifugal forces at its free end, thus causing a markedly higher load on the tie-up region of the fin to the rotor or to a heat shield of the rotor.

Further important features and advantages of the turbomachine according to the invention may be gathered from the drawings and from the accompanying figure description, with reference to the drawings.

BRIEF DESCRIPTION OF THE DRAWINGS

Preferred exemplary embodiments of the invention are illustrated in the drawings and they are explained in more detail in the following description, the same reference symbols referring to identical or similar or functionally identical components.

In the drawings, in each case diagrammatically.

DETAILED DESCRIPTION OF EXEMPLARY EMBODIMENTS

Figure 1:
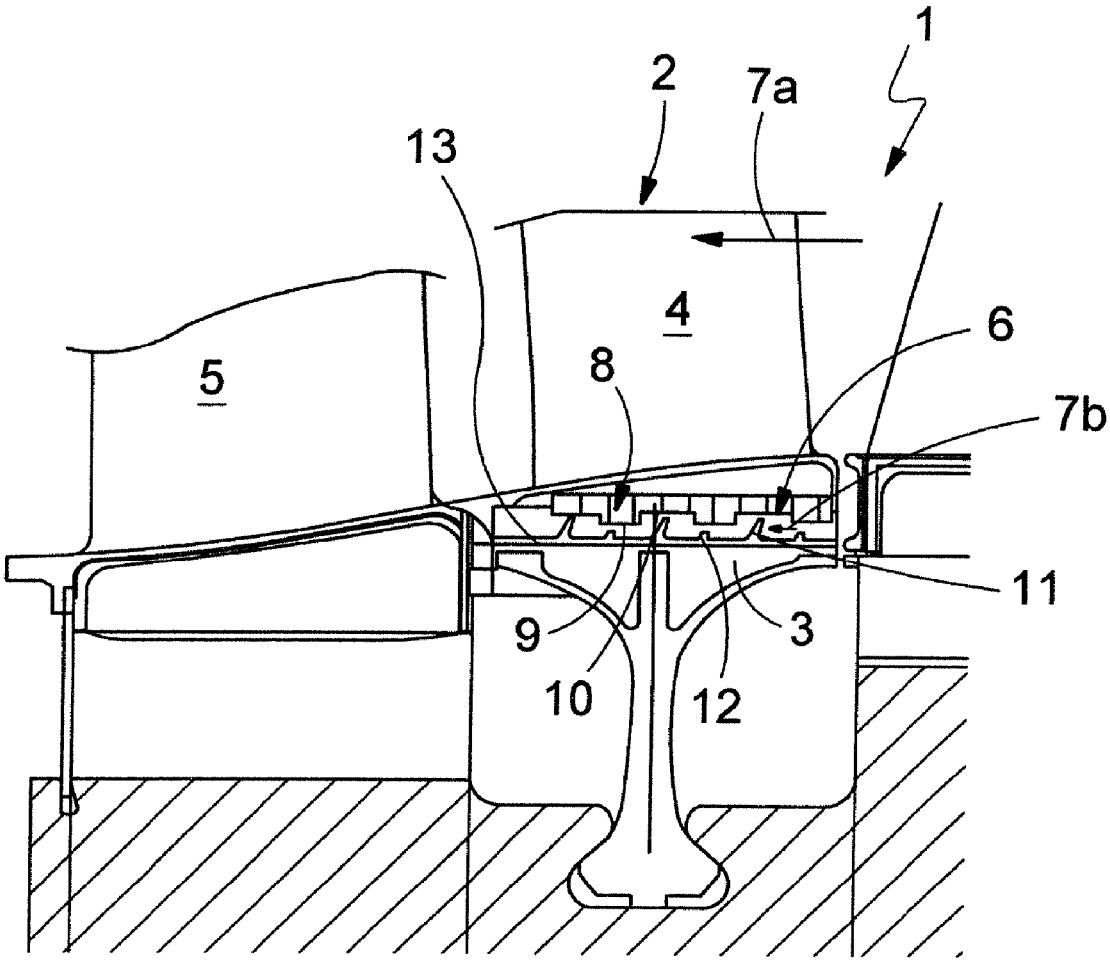
FIG. 1 shows an axial sectional illustration of a turbomachine in the region of a sealing device located between a stator and a rotor.

According to FIG. 1, a turbomachine 1, in particular a gas turbine or a compressor, has a stator 2 and a rotor 3. The stator 2 may in this case be designed, for example, as a guide vane 4. A moving blade 5 may be arranged in the usual manner upstream of the guide vane 4 in the flow direction 7.

In order to keep the efficiency of the turbomachine 1 as high as possible and, on the other hand, minimize oxidation processes due to an eruption of hot gas, at least one sealing device 6 is arranged between the stator 2 and the rotor 3. The sealing device 6 in this case runs in the axial direction of the turbomachine 1. On the stator side, the sealing device 6 has a radially stepped sealing contour 8 of honeycomb-like design, with regions 9 and 10 projecting and retracting in the direction of the rotor 3 (cf. also FIG. 2). By contrast, on the rotor side, a plurality of sealing fins 11 projecting in the direction of the stator 2 are arranged, which engage in each case into adjacent retracting regions 10 of the stator-side sealing contour 8. According to some principles of the present invention, in this case, on the rotor side, at least one additional fin 12 projecting in the direction of the stator 2 is additionally provided, which is positioned between two adjacent sealing fins 11 arranged on the rotor side and which lies opposite a projecting region 9 of the stator-side sealing contour 8.

The sealing fins 11 give rise, together with the radially stepped sealing contour 8, to a labyrinth seal which at least hinders a penetration of hot gases. So that the labyrinth effect can be increased further, then, additional fins 12, as they are known, are additionally arranged, which bear against the projecting regions 9 of the sealing contour 8 or even dig into this. Both the sealing fins 11 and the additional fins 12 are in this case produced from a material which is more wear-resistant, as compared with the sealing contour 8, so that, in the event of contact between the fins 11, 12 and the sealing contour 8, a stripping of the sealing contour 8 occurs and the fins 11, 12 dig into the sealing contour 8, with the result that the sealing action of the sealing device 6 is additionally improved.

As one may gather from FIGS. 1 and 2, at least one additional fin 12 and/or one sealing fin 11 are/is arranged, inclined radially and axially, on the rotor 3 or on a heat shield 13 of the rotor 3. In this case, a degree of inclination of the at least one additional fin 12 or of the at least one sealing fin 11 amounts to approximately 25°-35° with respect to a radial perpendicular to the axis of the turbomachine 1. The inclination of the sealing fins 11 or of the additional fins 12 in this case takes place in the direction opposite to the main flow 7*a*, as a result of which, upstream and/or downstream of the respective fin 11, 12, a dam flow, as it is known, may be formed, which is also designated as a dead water zone and which additionally improves the sealing action of the sealing device 6. Reference symbol 7*b* in this case designates the leakage flow between the stator 2 and the rotor 3.

Figures 2A, 2B, 2C, 2D, 2E:
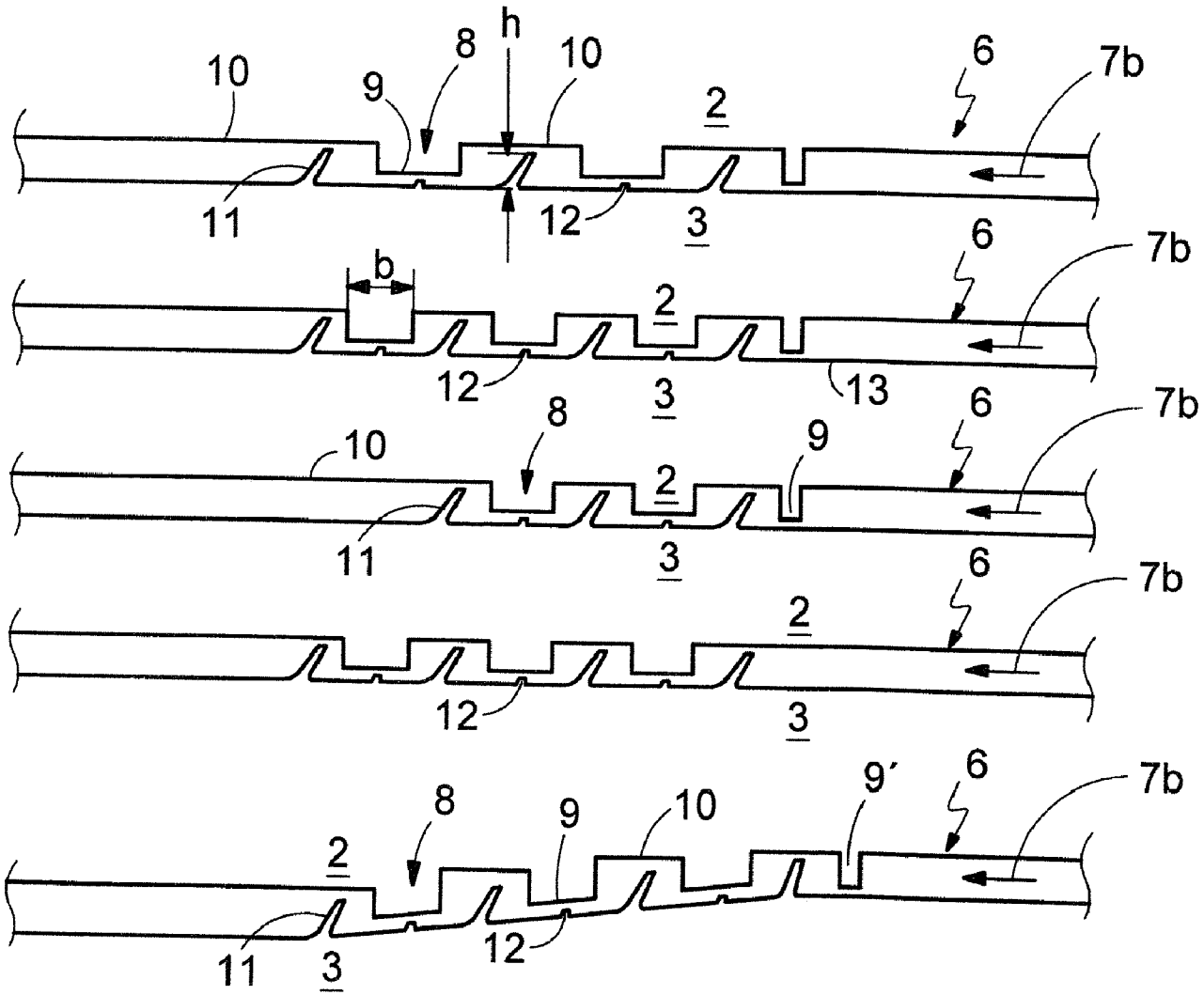
FIGS. 2*a* to 2*e* show different embodiments of the sealing device according to the invention.

FIGS. 2*a* to 2*e* show different embodiments of the sealing device 6, the sealing devices 6 according to FIGS. 2*a* to 2*d* having a uniform radial height over their entire axial extent, whereas a radial height of the sealing device 6 according to FIG. 2*e* varies in the axial direction of the turbomachine 1.

These sealing devices 6 are particularly suitable for instances in which the axial relative movement is greater than the radial relative movement. For this reason, all the sealing devices 6 according to FIGS. 1 and 2 have in this case in common the fact that the retracting regions 10 of the sealing contour 8 have a greater axial longitudinal extent than the projecting regions 9 of the sealing contour 8. Furthermore, an axial distance between two projecting or retracting stator-side regions 9 or 10 is approximately double a radial height of the sealing fin 11.

All the sealing devices 6 according to FIGS. 1 and 2 likewise have in common the fact that at least the sealing fins 11 have in each case a wedge-shaped cross-sectional profile in the circumferential direction and thereby, starting from their rotor-side tie-up, taper as far as a free end. This affords the advantage that a rotor-side tie-up region is designed to be stronger and therefore more load-bearing, while the free end of the sealing fin 11 is designed to be markedly lighter and therefore generates lower centrifugal forces.

Of course, a size both of the fins 11, 12 and of the projecting and retracting regions 9, 10 of the sealing contour 8 depends on structural requirements, the best sealing action being achieved when the various dimensions have specific geometric ratios. The stator-side retracting region 10 preferably has, in this case, an axial longitudinal extent of approximately twice to three times the height h, illustrated in longitudinal section, of the sealing fin 11, while a stator-side projecting region 9 has an axial longitudinal extent of approximately 1 to 2.5 times the height h, that is to say a width b, illustrated in longitudinal section, of 1 to 2.5 times h.

It may likewise be gathered from FIGS. 1 and 2 that a radial height of the sealing fin 11 is approximately 2 to 4 times greater than a radial height of the additional fin 12. In the same way as the axial longitudinal extents, mentioned in the previous paragraph, of the regions 9 and 10, in this case the radial height both of the additional fin 12 and of the sealing fin 11 is governed by structural requirements.

In FIGS. 2*a* to 2*c* and 2*e*, a last projecting region 9' is designed to be markedly narrower, that is to say with a markedly smaller axial longitudinal extent, while, according to FIG. 2*b*, it is completely absent. Furthermore, all the sealing contours according to FIGS. 1 and 2 have in common the fact that the projecting and retracting regions 9 and 10 have a rectangular stepped cross-sectional configuration, the intention also being that differently stepped or wavy cross-sectional shapes are also optional. In general, combinations of sealing fins 11 and additional fins 12 which are optimized in terms of the sealing action may be used, and the sealing fins 1 and/or the additional fins may preferably be inclined opposite to the main flow direction 7*a*.

List of reference symbols

| | |
|---|---|
| 1 | Turbomachine |
| 2 | Stator |
| 3 | Rotor |
| 4 | Guide vane |
| 5 | Moving blade |
| 6 | Sealing device |
| 7a | Main flow |
| 7b | Leakage flow |
| 8 | Sealing contour |
| 9 | Projecting region |

-continued

| List of reference symbols | |
|---|---|
| 10 | Retracting region |
| 11 | Sealing fin |
| 12 | Additional fin |
| 13 | Heat shield |
| b | Width, axial longitudinal extent |
| h | Height of the sealing fin 11 |

While the invention has been described in detail with reference to exemplary embodiments thereof, it will be apparent to one skilled in the art that various changes can be made, and equivalents employed, without departing from the scope of the invention. The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

What is claimed is:

1. A turbomachine comprising:

a stator, a rotor, and an axial sealing device arranged between the stator and the rotor, wherein the sealing device has on the stator side a radially stepped sealing honeycomb contour with regions projecting and retracting in the direction of the rotor;

a plurality of sealing fins on the rotor side projecting in the direction of the stator, each of the plurality of sealing fins engaging into adjacent retracting regions of the stator-side sealing contour; and at least one additional fin on the rotor side projecting in the direction of the stator, the at least one additional fin positioned between two adjacent sealing fins arranged on the rotor side and lying opposite a projecting region of the stator-side sealing contour;

wherein at least one of the at least one additional fin, at least one of the plurality of sealing fins, or both, is arranged inclined radially and axially on the rotor;

wherein a degree of inclination of the at least one additional fin, of the at least one sealing fin, or of both, is approximately 25° to 35°.

2. The turbomachine as claimed in claim 1, wherein the at least one additional fin, the plurality of sealing fins, or both, is inclined in the direction opposite to the main flow.

3. The turbomachine as claimed in claim 1, wherein an axial distance between two projecting or retracting stator-side regions is approximately double a radial height (h) of the plurality of sealing fins.

4. The turbomachine as claimed in claim 3, wherein the radial height (h) of the plurality of sealing fins is 2 to 4 times greater than a radial height of the at least one additional fin.

5. The turbomachine as claimed in claim 1, wherein a stator-side retracting region is wider than a stator-side projecting region.

6. The turbomachine as claimed in claim 1, wherein a stator-side retracting region has an axial longitudinal extent of twice to three times a radial height (h) of the plurality of sealing fins, and a stator-side projecting region has an axial longitudinal extent of 1 to 2.5 times said radial height (h).

7. The turbomachine as claimed in claim 1, wherein the plurality of sealing fins each have a wedge-shaped cross-sectional profile in the circumferential direction.

* * * * *